US005145141A

United States Patent [19]

Hunter

[11] Patent Number: 5,145,141

[45] Date of Patent: Sep. 8, 1992

[54] CLIPBOARD

[76] Inventor: Mark A. Hunter, P.O. Box 1068, Afton, Wyo. 83110

[21] Appl. No.: 667,454

[22] Filed: Mar. 11, 1991

[51] Int. Cl.[5] ..... A47B 97/04

[52] U.S. Cl. ..... 248/452; 248/444.1; 281/45

[58] Field of Search ..... 248/452, 451, 450, 441.1, 248/444.1; 211/45; 281/45

[56] References Cited

U.S. PATENT DOCUMENTS

| | | | |
|---|---|---|---|
| 922,610 | 5/1909 | Mills | 248/444.1 |
| 2,023,802 | 12/1935 | Brown | 281/45 |
| 3,809,352 | 5/1974 | Mathias | 248/451 |
| 4,442,780 | 4/1984 | Child . | |
| 4,445,728 | 5/1984 | Bratton . | |
| 4,465,255 | 8/1984 | Hill | 248/451 |
| 4,665,620 | 5/1987 | Osteen . | |
| 4,681,291 | 7/1987 | Holladay | 248/444.1 |
| 4,734,242 | 3/1988 | Gleave . | |
| 4,892,334 | 1/1990 | Sinclair | 281/45 |

*Primary Examiner*—J. Franklin Foss
*Attorney, Agent, or Firm*—Trask, Britt & Rossa

[57] ABSTRACT

A clipboard adapted for multi-functional use is disclosed. The clipboard includes a pair of panel-like members which are releaseably joined to one another to form an assembly. The panel-like members are separable one from another whereby a sheet of paper having information printed thereon may be inserted between the panel members to be interposed therebetween. One or both of the panel members is fabricated from a transparent material which permits the user to view the information on the sheet of paper through the panel member itself. A conventional clip assembly is mounted on one or both of the panels to releaseably retain a sheet of paper atop one of the panels whereby the user may either read or write on the paper utilizing the underlying panel as a writing surface.

11 Claims, 3 Drawing Sheets

CLIPBOARD

BACKGROUND OF THE INVENTION

1. Field

This invention relates to clipboards, more particularly, this invention is directed to clipboards having a multi-functional character.

2. Statement of the Art

Clipboards of various constructions have been known for many years. In its most simple construction, a clipboard typically includes a planar member fabricated from a rigid material. The planar member is sufficiently smooth so that an individual may place a sheet of paper or other material atop the planar surface and thereafter either read the paper or write on the sheet of paper using a conventional writing instrument such as a pencil or pen. In many constructions, a clip member is attached to the planar member as a means of retaining the sheet of paper atop the writing surface of the planar member.

Many efforts have been directed in the past to modify the conventional clipboard structure to increase its functionality. For example, in U.S. Pat. No. 4,445,728 (Bratton), a plurality of clear, upstanding planar members were fitted about the perimeter of the clipboard to form a shroud or shield. Bratton thereby disclosed a clipboard structure which may be used in out-of-door environments whereby the sheet member, positioned atop the clipboard may be retained protected from wind or other disturbances. In U.S. Pat. No. 4,442,780 (Child), a clipboard having an alternative shield structure was disclosed.

Other inventive attempts have been directed to modifying a clipboard structure to provide an auxiliary function. For example, in U.S. Pat. No. 4,665,620 (Osteen), a clipboard was structurally combined with a tape measure to yield a unitary structure adapted to serve both the function of a clipboard and that of a tape measure. Other clipboard structures which have been publicly disclosed are those which are made subject to U.S. Pat. No. 4,832,369; U.S. Pat. No. 4,745,286; U.S. Pat. No. 4,610,324; U.S. Pat. No. 4,423,888; U.S. Pat. No. 3,833,970; U.S. Pat. No. 3,560,092; U.S. Des. Patent D-261,903; U.S. Des. Patent D-255,251; and U.S. Des. Patent D-243,974.

In many working environments, it is incumbent upon a workman to fill out a form or otherwise take notes with regard to the subject matter of his work. Oftentimes, it is necessary for the workman to make reference to a printed sheet of data for purposes of making comparisons of that data with observations he is presently making. For example, many state governments in the United States have enacted laws governing the dimensions and weight requirements of semi-truck trailers which travel over roads within the state's boundaries. In order to monitor and otherwise enforce these laws, most states have provided for a number of enforcement officers who are either stationed in fixed locations on the highways proximate the state's boundaries or in the alternative, many states provide for mobile enforcement units which travel along the state's highways and randomly stop traveling semi-truck trailers for purposes of assessing compliance with the various state regulations regarding weight and dimensions of the semi-truck trailer. It is incumbent upon the enforcement officer to take physical measurements of the semi-truck trailer, oftentimes in the out-of-doors, and thereafter compare those measurements with the standards promulgated by the state legislatures. While clipboards have often been used in this environment for purposes of retaining a sheet upon which the enforcement officer may take down notes regarding the data and observations he makes while taking measurements of the vehicle, it has been found difficult for the officer to retain and preserve a sheet of information which includes the state standards which the vehicle must meet. Since the paper if having the standards written thereon is fairly flexible and thin, and should it be retained on the clipboard by the clip of the clipboard, after repeated usage, the sheet becomes tore, soiled, and otherwise unusable. Should the user fold the paper so as to place it in his pocket or use an alternative means of carrying the paper, a similar result, i.e., soiling and tearing of the paper, often results. While this one examples illustrates the problems incumbent upon a workman, it should be observed that similar problems exist in a plethora of other environments.

Therefore there exists a need for a means of providing a means of retaining a sheet of paper, having information thereon, in a substantially protected and shrouded condition, which paper may then be readily used by a workman or enforcement officer as a reference while taking notes on a second sheet of paper. Furthermore, it is realized that since the clipboard on which the second sheet is to be filled out already provides a first piece of equipment for which the officer is obliged to maintain, there exists a need for a means of adapting that clipboard whereby the officer may have a unitary piece of equipment which both serves the purposes of retaining a second sheet, providing a writing surface on which the second sheet may be written upon, and further more, providing a means of shrouding or protecting the data sheet upon which the observations which are to be noted on the second sheet may thereafter be compared.

SUMMARY OF THE INVENTION

A clipboard which performs all of the traditional functions of a clipboard, i.e., providing a writing surface and a means of detachably retaining a sheet of paper thereon whereby that sheet may be written upon by the user has been adapted to prevent its simultaneous use in receiving and retain a sheet having data written thereon and protecting that data sheet from the elements.

The clipboard of the invention includes a first panel member and a second panel member. The two panel members are positioned one atop another. The upper lowest panel member includes a planar surface which is adapted to provide a writing surface for the user. A clip means is mounted on the uppermost panel member as a means of releasably retaining a sheet of writing paper on the writing surface provided by the uppermost panel member. A connection means is secured to the lower panel member and the upper panel member and is adapted to releasably secure the two panel members one against the other in an abutting relationship. In one construction, the connection means is positioned proximate a first proximal end of the lower panel member and the upper panel member and thereby applys a force against those two members to retain the two ends of the panel members in an abutting relationship one against the other. In some constructions, the panel members are formed by rectangularly perimetered, planar panels which each have an upper and a lower planar surface. In this particular construction, the lower surface of the upper panel member is held in abutment against the upper surface of the lower panel member. Upon the release of the connection member sufficiently that the two panel members can be separated from one another at the ends thereof opposite from the connection mans a sheet of paper or other material may be slid in between the two panel members to a position therebetween such that upon the release of the two panel ends, the sheet of paper is retained interposed between the two panel members in a sandwich-type arrangement. The connection means may then be tightened to secure the paper in place by forcedly pressuring the engagement of the two panels against one another. One or both of the panel members may be fabricated from a transparent material. This permits the user to view writing or other contents of the sheet of paper sandwiched between the panel members. Furthermore, the panel members may be dimensioned sufficiently large that the entire body of the sheet of paper may be completely retained between the panel members thereby ensuring its protection.

DETAILED DESCRIPTION OF THE ILLUSTRATED EMBODIMENT

Figure 1:
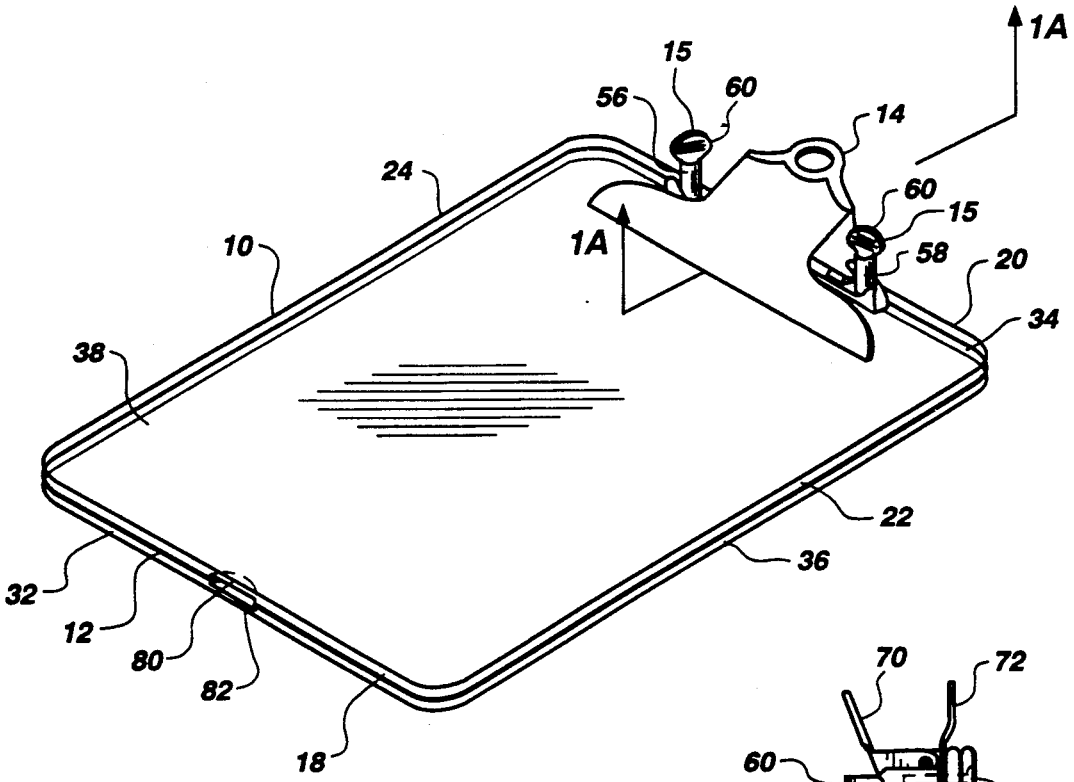
FIG. 1 is a perspective view of a clipboard of the instant invention.

As shown in FIG. 1, the construction of the instant invention includes a first planar panel 10, a second planar panel 12, a clasp or clip structure 14 mounted on the first panel 10 and a connection means 15 adapted for detachably connecting the first panel 10 with the second panel 12. The connection means 15 is adapted to forcibly abut one end of the panel 10 with the corresponding end of the panel 12 whereby a sheet of paper having information thereon may be detachably retained between the panel 10 and the panel 12.

Figure 2:
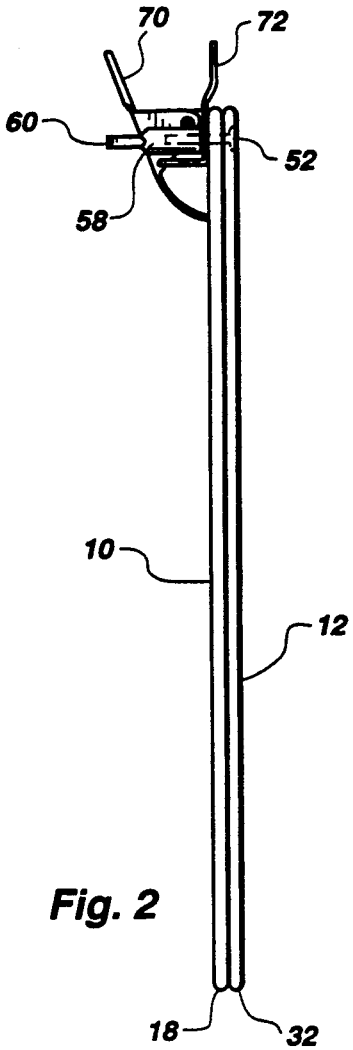
FIG. 2 is a side view of the clipboard as shown in FIG. 1.
Figure 3:
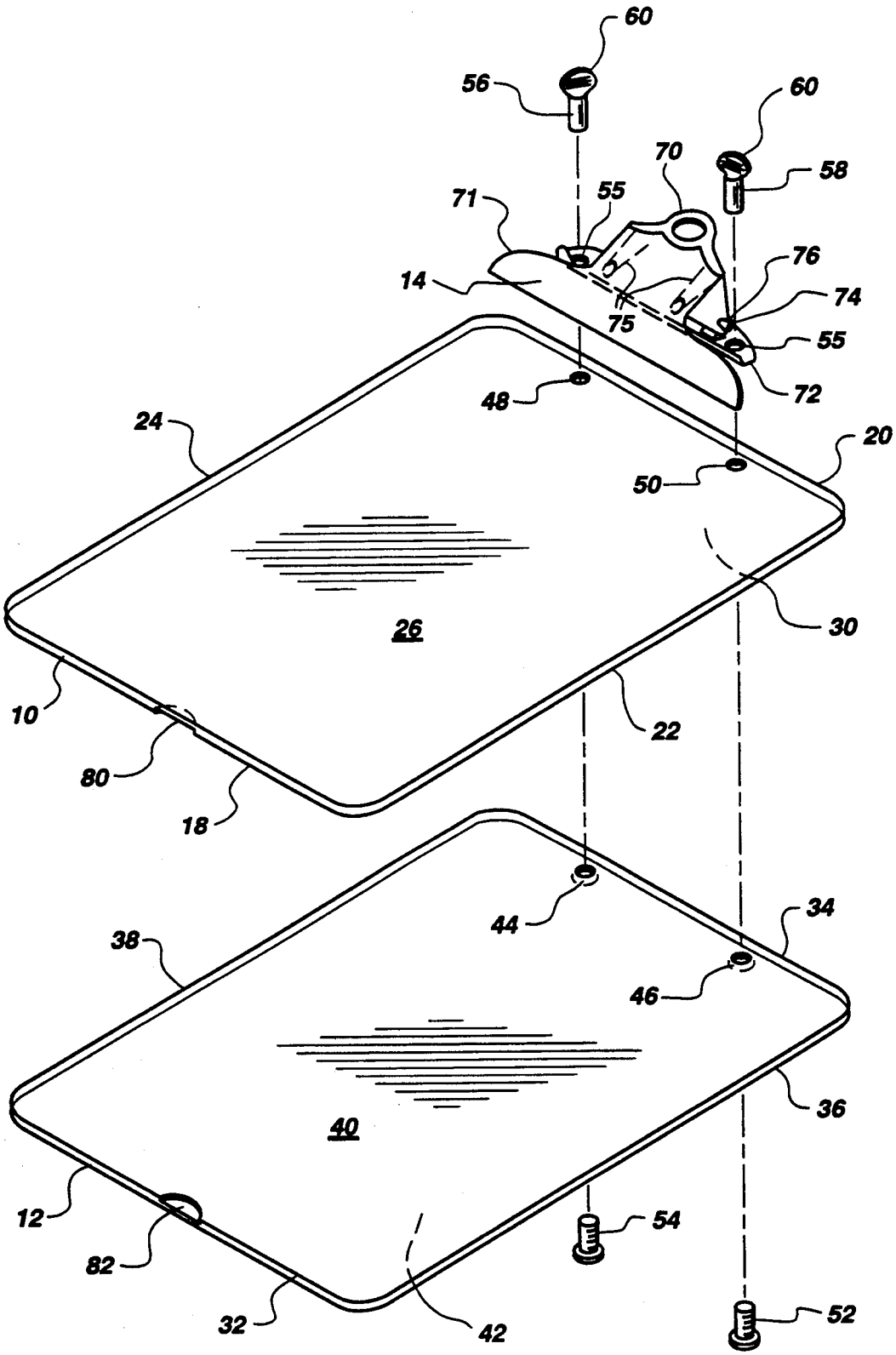
FIG. 3 is an exploded view of the clipboard of FIG. 1.

As shown in FIGS. 1 and 3, the first planar panel 10 is generally rectangular in configuration. The panel 10 defines a top flat planar surface 26 which is configured to form a smooth writing surface upon which a sheet paper may be placed and written upon. The panel 10 has a first end 18 and a second end 20. The ends are generally linear in configuration and are positioned spacedly apart from one another. Furthermore, the ends 18 and 20 are positioned generally parallel to one another. The panel 10 also has two opposing sides generally identified as side 22 and side 24. Both side 22 and side 24 are linear in configuration and are positioned spacedly apart from one another, and are positioned parallel to one another. The opposing ends of each side 22 and 24 are interconnected with a respective end of one of the ends 18 and 20 thereby forming a generally rectangular configuration. The top panel 10 has a planar flat bottom surface 30 as shown in FIG. 3. As shown in FIG. 2, the planar panel 10 has a generally flat disc-like or sheet-like appearance when viewed from the side. The width of the panel 10 is substantially constant over the complete area of the panel.

The second panel 12 as shown to advantage in FIGS. 1, 2, and 3 is substantially similar to panel 10 as described above. As shown, the planar panel 12 has a first end 32 which is linear in configuration and an opposing end 34 which likewise is linear in configuration. The ends 32 and 34 are positioned spacedly apart from one another and are oriented parallel to one another. The bottom panel 12 furthermore has two opposing sides 36 and 38. Both of the sides 36 and 38 are linear in configuration. The sides 36 and 38 further more are positioned spacedly apart from one another and are positioned parallel to one another. Each of the sides 36 and 38 have two opposing ends. Each of these ends is connected to a respective end of either the end 32 or the end 34 whereby the sides 36 and 38 and the ends 32 and 34 as shown in FIG. 3 define a generally rectangularly configured perimeter. The uppermost surface 40 of panel 12 is flat and planar in configuration. The lower surface 42 of panel 12 likewise is planar and flat in configuration.

As shown in FIGS. 1 and 3, the shape and dimensions of both the panels 10 and 12 are such that when placed one on top of the other, the panels generally correspond and register one with the other thereby forming a generally rectangular member having planar upright sidewalls and endwalls about its perimeter. In one construction of the invention, the top panel 10 may be fabricated from a transparent material. In alternative constructions, the bottom panel 12 may be fabricated from a transparent material. In some constructions, both the top panel 10 and the bottom panel 12 may both be fabricated from a transparent material.

When the two panels 10 and 12 are positioned one on top of the other, the top surface 40 of the lower panel 12 abuts against the bottom surface 30 of the top panel 10. Due to the fact that both of these surfaces are planar in configuration, the abutment of the one surface against the other generally provides a contact between the two surfaces over the entire area of those surfaces.

As shown in FIG. 3, the bottom panel 12 defines two apertures 44 and 46 proximate the end 34 thereof which extend through the complete thickness of the panel 12. These two apertures are positioned spacedly apart from one another and are removed from the edge of the end 34. Similarly, the top panel 10 likewise defines two apertures 48 and 50 which pass through the entire thickness of the panel 10. Similar to apertures 44 and 46, the apertures in the panel 10 mainly are spacedly removed from the edge of the end 20 of the panel 10. The apertures 48 and 50 and 44 and 46 are oriented such that one at each apertures registers with a corresponding aperture in the other panel. For example, as shown in FIG. 3, the aperture 48 is positioned within panel 10 to register with the aperture 44 in panel 12 when the two panels 10 and 12 are positioned one atop the other. This register permits the passage through each pair of apertures of a respective threaded male member 54 and 52 as shown in FIG. 3. Each threaded member 52 and 54 passes through a respective pair of apertures through the two panels and extend upwardly beyond the panels a predetermined distance. A pair of female-threaded sockets 56 and 58 is provided. Each socket is adapted to threadedly receive a respective threaded male member 52 and 54 to form a threaded connection therewith. Each of the threaded socket-like members 56 and 58 defines at its uppermost end a handle 60 which is configured to be grasped by the user's fingers and provide a means of manually threading the sockets 56 and 58 onto their respective male-threaded members 52 and 54. The handles 60 are specifically adapted to permit the user to manually thread and unthread the sockets 56 and 58 without the use of tools.

As shown, the handles 60 may be a substantially thin, ribbed member which provides a sufficient surface area to be grasped by the user and apply a sufficient force to the socket 56 and 58 sufficient to cause its rotation about the threaded members 52 and 54.

As shown in FIGS. 1 and 2, a conventional clasp member 70 is shown positioned atop the upper surface 26 of the panel 10. The clasp which includes a clip-like structure 71 which is pivotally mounted on a base member 72 by means of pivot axle 74 which extend outward from the clip 70 to be received within a respective pair of apertures 76 defined by the frame member 72. The clip structure which operates in a conventional manner is biased by one or more springs 75 into abutment against the upper surface 26 of the panel 10.

Figure 1A:
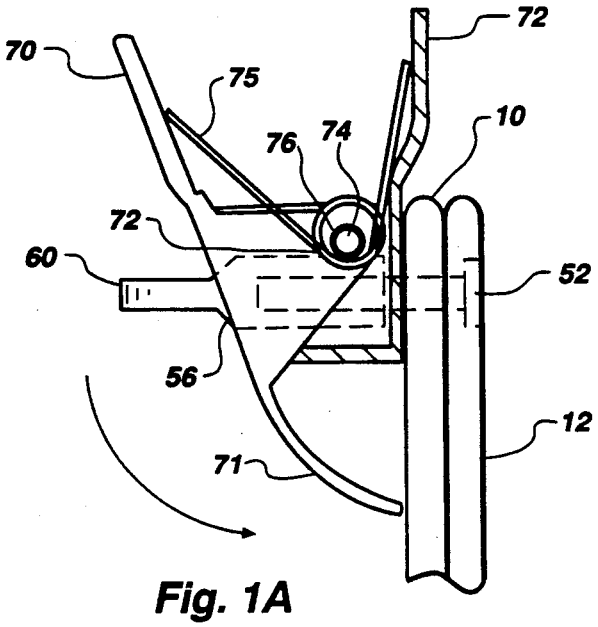
FIG. 1A is a partial cross-sectional view of the clip shown in FIG. 1 taken along section lines 1A—1A.

As shown in FIG. 1A, the spring 76 is wrapped about the axle 74. One end of the spring abuts against the clip 71, the other end of the spring abuts against the base 72. The spring is adapted to urge the clip 71 in the direction shown by the arrow in FIG. 1A. The frame 72 of the clasp defines two opposing apertures 55 therethrough which are positioned and dimensioned so as to each receive a respective male-threaded member 52 and 54 therethrough such that upon the placement of the clasp 70 atop the upper surface 26 of panel 10, each of the apertures 55 is positioned in registration with a pair of apertures either 44 and 48 or 46 and 50. A respective male-threaded member 52 and 54 may thereafter be inserted through the respective pair of apertures in the panel 10 and 12 and thereafter to extend through the respective aperture 55 in the clasp 70. The respective sockets 56 and 58 may thereafter be threadedly engaged with the male-threaded members 52 and 54 to form a threaded engagement of the two panels 10 and 12 in abutment one against the other with the clasp member 70 being positioned atop the panel 10.

Each of the panels 10 and 12 furthermore defines proximate their respective end 18 and 32 a notched recess 80 and 82. As shown to advantage in FIG. 3, these recesses in case of panel 10, the recess 80 is defined proximate the lower surface 30 and extends upwardly through a partial height of the panel 10. In the case of the lower panel 12, the recess 82 communicates with the upper surface 40 and extends downwardly through a partial height of the panel 12. Each of the recesses 80 and 82 are dimensioned sufficiently to permit a user to insert his finger therein sufficiently to apply a lever-type force against the panel and thereby separate the two panels one from the other approximate the end 18 and 32.

Figure 4:
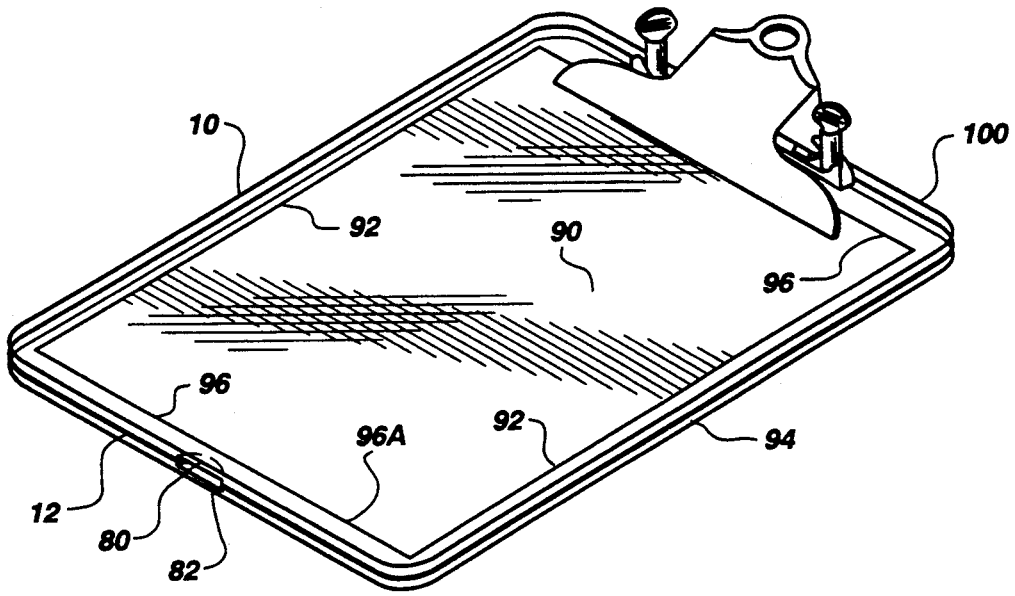
FIG. 4 is a perspective view of the clipboard of FIG. 1 having a data sheet positioned between the opposing pair of planar surface members.

As shown in FIG. 4, since at least one of the said panels is fabricated from a transparent material, the assembly permits the user to take a sheet of paper or other sheet of material and position that sheet between the two panels whereby the user may view any data or information which may be on either side of the paper through the transparent panel 10 or 12 or both. As shown in FIG. 4, the sheet 90 is dimensioned to be received between the two panels 10 and 12 and to be interposed there between in a sandwich-like construction. The sheet 90 is dimensioned such that its edges 92 are sufficiently removed from the opposing edges 94 of the two panel assembly such that the edges 92 are protected from contact with the external environment. Furthermore, the opposing end 96 of the sheet 90 likewise are spatially removed from the ends 98 and 100 of the two panel assembly so that they too are likewise protected from the environment. Observably, in the present construction, the sheet 90 is shielded from the environment while at the same time, the information printed or contained thereon is readily accessible and visible by the user through either the panel 10 or panel 12 or both. It follows that the sheet 90 may be preserved against damage, i.e., shredding, soiling, tearing, or similar damage, at the same time, the information presented thereon is readily available for use by the clipboard user. Furthermore, the clipboard is also usable in its conventional manner.

Figure 5:
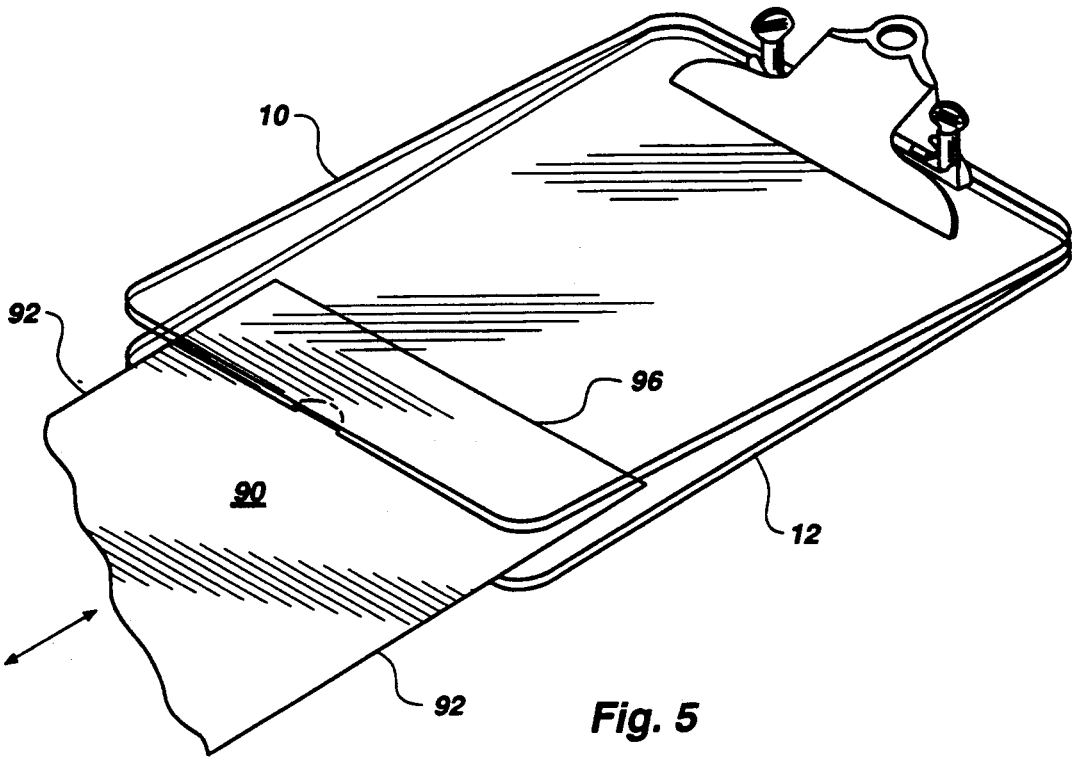
FIG. 5 is a perspective view of the clipboard of FIG. 1 wherein a data sheet is shown being removed from the clipboard.

In the construction shown in FIG. 4, the sheet 90 has been inserted to be interposed between the two panels and thereafter, the threaded sockets 56 and 58 have been tightened or threadedly inserted onto the male-threaded members 52 and 54 such that a force has been applied against the two panels on one side by means of the action of the sockets 56 and 58 against the frame 72. That frame thereafter acts against the upper surface 26 of panel 10. On the opposing side, the heads of the male-threaded members 52 and 54 act against the bottom surface 42 of the panel 12 thereby forces are applied not only against the top surface of the panel 10 but also against the bottom surface of the panel 12 to thereby forcedly urge the two panels into abutment proximate their ends 20 and 34. The connection assembly comprised of the male-threaded member 52 and 54 and their respective female-threaded sockets 56 and 58 is sufficient such that the force applied to the panel is such that as to apply a frictional drag and pressure force against the sheet 90 and thereby retain that sheet in position between the two panels 10 and 12, i.e., the panels 10 and 12 are urged sufficiently against one another that the surfaces 30 and 40 thereof are urged into abutment against the sheet 90 sufficiently to retain that sheet in place in its position between the two panels. When it is desirable to remove the sheet 90 from its positioning within the clipboard assembly and also for purposes of replacing sheet 90 with a subsequent sheet, the user simply grasps the handle 60 of each of the threaded sockets 56 and 58 and threadedly unscrews those sockets from their respective male-threaded members 52 and 54 sufficiently to release the force on the two panels 10 and 12. The sheet 90 may then be removed, as shown in FIG. 5. Subsequent to the user unscrewing the threaded sockets 56 and 58, the user may thereafter insert his finger or another lever member into the recess formed by notches 80 and 82 and thereby apply a lever-like force against the two panels urging them apart into the configuration shown in FIG. 5. In this configuration, the sheet 90 may be grasped by the user by inserting his fingers through the opening defined by the spaced-apart ends 18 and 32 sufficiently to grasp the end 96*a* on the sheet 90 and pull that sheet outwardly from the clipboard until the sheet is physically separated from the clipboard assembly. Should the user desire to substitute an alternative sheet 90, the user simply retains the two panels 10 and 12 in a spatially separated configuration as shown in FIG. 5. The ends 18 and 32 are spacedly positioned apart from one another sufficiently that the user may thereafter insert the sheet through the opening formed by the spaced-apart ends 18 and 32 and direct the sheet 90 into the location or orientation shown in FIG. 4 upon the sheet being so positioned, the user thereafter removes the force application to the two panels proximate the ends 18 and 32 allowing the two ends to come back into a generally abutting position as shown in FIG. 4. The user may thereafter readily insert the sockets 56 and 58, thread them down on their respective members 52 and 54 sufficiently to apply a force against the two panels and thereafter again create any forced pressure needed of the two panels proximate their end 20 and 34 sufficient to retain the sheet 90 in its sandwiched positioned interposed between the opposing surfaces 30 and 40.

The construction material utilized in forming the panels 10 and 12 is preferably a material having some degree of resilience whereby the panels may be urged away from one as shown in FIG. 5 without the panels breaking. It is therefore desired that the panels 10 and 12 have some degree of flexibility. This flexibility permits the user to loosen the panels by loosening the female threaded sockets and thereafter rely on the flexibility of the panels to permit the opening or separation of the panels shown in FIG. 5. Understandably, more rigid panels 10, 12 would require a greater amount of loosening of the sockets in order to remove the sheet of paper 10. Various types of plastic, acrylic, or other synthetic material are contemplated for use in fabricating the two panels.

It is to be understood that the instantly described embodiment is intended solely as a description of a preferred embodiment. Those skilled in the art will recognize that the embodiment herein discussed are illustrative of the general principles of the invention. The embodiments herein described are not intended to limit the scope of the claims which themselves recite what applicant regards as his invention.

What is claimed:

1. A clipboard comprising:

a first rigid planar panel having a first end and a second end, said first planar panel being transparent;

a second rigid planar panel, having a first end and a second end;

connection means for detachably connecting said first end of said first planar panel to said first end of said second planar panel, said connection means positioning said first planar panel in parallel with said second planar panel, said planar panels being detachably held in abutment one against another;

a clip means mounted on said first planar panel adapted for releaseably securing sheets of paper on an outwardly oriented face of said first planar panel; and a sheet having a first face and a second face interposed between said planar panels removably retained therebetween by said connection means operating on said planar panels to abut said first planar panel against the entire surface of said first face and to abut said second planar panel against the entire surface of said second face, said sheet being visible through said first planar panel.

2. The clipboard of claim 1, wherein said second planar panel is transparent.

3. The clipboard of claim 1, wherein each said planar panel defines an aperture therein, said apertures in said planar panels being in registration and said connection means comprising:

a male threaded bolt inserted through said apertures, said male threaded bolt having a head which engages said second planar panel, and a female threaded nut, threadedly secured on said male threaded bolt, said female threaded nut abutting against said first planar panel and urging said first planar panel into abutment against said second planar panel.

4. The clipboard of claim 3, wherein said apertures are defined proximate said first end of each said first and second planar panel.

5. The clipboard of claim 1, wherein said second end of said first planar panel defines a recess well therein dimensioned to receive a lever member for forcedly urging said second end of said first planar panel outwardly away from said second end of said second planar panel.

6. The clipboard of claim 1, wherein said second planar panel defines a recess well therein dimensioned to receive a lever member for forcedly urging said second end of said first planar panel outwardly away from said second end of said second planar panel.

7. The clipboard of claim 5, wherein said second planar panel defines a recess well therein dimensioned to receive a lever member for forcedly urging said second end of said first planar panel outwardly away from said second end of said second planar panel.

8. The clipboard of claim 1, wherein said clip means comprises:

a support frame mounted on said first planar panel;

a clip member pivotedly mounted on said support frame; and a spring mounted on said support frame and said clip member to urge said clip member into a forced engagement against said first planar panel.

9. The clipboard of claim 3, wherein said female threaded nut includes a hand graspable handle adapted for facilitating a user's manually manipulated threaded engagement and disengagement of said nut from said male threaded bolt.

10. The clipboard of claim 1, wherein said connection means comprises a pair of said male threaded bolts and a respective pair of said female threaded nuts, said male threaded bolts being spacedly positioned apart from one another and each said male-threaded bolt being received within a respective said pair of registered apertures defined within said first and second planar panels.

11. A clipboard consisting essentially of:

a first rigid planar panel having a first end and a second end, said first rigid planar panel being transparent, said first end of said first rigid planar panel defining a pair of spacedly positioned apertures therein, said second end of said first rigid planar panel defining a notch-like recess well therein;

a second rigid planar panel having a first end and a second end, said second planar rigid panel being transparent;

said first end of said second rigid planar panel defining a pair of spacedly positioned apertures therein; said pair of apertures in said first rigid planar panel being in registration with said pair of apertures in said second rigid planar panel;

a first sheet of paper having an upper face and a lower face, said first sheet of paper being positioned on said second rigid planar panel such that said lower face completely contacts said second rigid planar panel;

a clip mounted on said first rigid planar panel, said clip including a support frame mounted on said first rigid planar panel; a clip member pivotedly mounted to said support frame and a spring secured to said support frame and said clip member, said spring being adapted to forcedly urge said clip member into engagement with said first rigid planar panel, said clip being adapted to removably secure a second sheet of paper against said first rigid planar panel;

a pair of male threaded bolts, each said male threaded bolt having a head, each male threaded bolt being inserted through a respective pair of registered apertures in said first and second rigid planar panels wherein said heads of said male threaded bolts are positioned in abutment against said second rigid planar panel;

a pair of female threaded nuts, each said female threaded nut being threadedly mounted on a respective said male threaded bolt, each said female threaded nut having a hand graspable handle suited for manual threading of said nut on its respective said male threaded bolt; said male threaded bolts in association with said female threaded nuts forcedly abuts said first rigid planar panel against the entire surface of said upper face of said first sheet of paper, said first sheet of paper being releasably retained between said first and second rigid planar panels by said association.

* * * * *